US008020705B2

(12) United States Patent
Hukki et al.

(10) Patent No.: US 8,020,705 B2
(45) Date of Patent: Sep. 20, 2011

(54) SCREEN ASSEMBLIES UTILIZING SCREEN ELEMENTS RETAINED IN PERFORATED SUPPORTS

(76) Inventors: Ari M. Hukki, Boynton Beach, FL (US); Glenn T. Lilie, Pearland, TX (US)

( * ) Notice: Subject to any disclaimer, the term of this patent is extended or adjusted under 35 U.S.C. 154(b) by 641 days.

(21) Appl. No.: 11/894,107

(22) Filed: Aug. 20, 2007

(65) Prior Publication Data

US 2008/0093268 A1 Apr. 24, 2008

Related U.S. Application Data

(60) Provisional application No. 60/838,565, filed on Aug. 18, 2006.

(51) Int. Cl.
*B07B 1/46* (2006.01)

(52) U.S. Cl. ..... 209/399; 209/274

(58) Field of Classification Search ..... 209/274, 209/395, 397, 399, 405, 409
See application file for complete search history.

(56) References Cited

U.S. PATENT DOCUMENTS

| | | | | |
|---|---|---|---|---|
| 1,098,979 | A * | 6/1914 | Schuchard | 209/457 |
| 1,989,777 | A * | 2/1935 | Wettlaufer | 209/17 |
| 4,892,767 | A * | 1/1990 | Freissle | 428/52 |
| 5,755,334 | A * | 5/1998 | Wojcik et al. | 209/399 |
| 5,769,241 | A * | 6/1998 | Woodgate | 209/399 |
| 6,253,926 | B1 * | 7/2001 | Woodgate | 209/399 |
| 7,240,801 | B2 * | 7/2007 | Freissle et al. | 209/405 |
| 7,264,125 | B2 * | 9/2007 | Lipa | 209/397 |
| 2006/0037891 | A1 * | 2/2006 | Lilie et al. | 209/397 |
| 2008/0230448 | A1 * | 9/2008 | Wojciechowski et al. | 209/254 |

* cited by examiner

*Primary Examiner* — Joseph C Rodriguez
*Assistant Examiner* — Kalyanavenkateshware Kumar
(74) *Attorney, Agent, or Firm* — Strasburger & Price, LLP

(57) ABSTRACT

A screen retention mechanism for use with vibratory separators is disclosed. The screen retention mechanism includes a structural frame mounted to a vibratory separator into which a plurality of lightweight and flexible screen elements are inserted into multiple tows of perforated screen supports. The perforated screen supports are bonded to the structural frame and are aligned parallel to the direction in which solids are conveyed by a vibratory motion. The invention further features an improved retention mechanism whereby screen elements are conveniently and selectively restrained.

22 Claims, 17 Drawing Sheets

SCREEN ASSEMBLIES UTILIZING SCREEN ELEMENTS RETAINED IN PERFORATED SUPPORTS

CROSS-REFERENCE TO RELATED APPLICATIONS

This Non-Provisional patent application, filed under 35 U.S.C. §111(a), claims the benefit under 35 U.S.C. §119(e)(1) of U.S. Provisional Patent Application No. 60/838,565, filed under 35 U.S.C. §111(b) on Aug. 18, 2006, and which is hereby incorporated by reference in its entirety. This Non-Provisional patent application is related to U.S. application Ser. No. 10/922,342, entitled "Screen assemblies utilizing screen elements retained in perforated troughs," and filed on Aug. 20, 2004, and to U.S. Provisional Patent Application No. 60/839,141, entitled "Screen element," and filed Aug. 16, 2006.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION-BY-REFERENCE OF MATERIAL SUBMITTED ON COMPACT DISC

Not applicable.

BACKGROUND OF THE INVENTION

1. Field of the Invention

The present invention relates generally to means by which material is separated or assorted according to size or dimensions of components by presentation to a series of openings or passages through which the components having dimensions below those of the openings or passages pass while those having dimensions greater than those of the passages or openings do not pass through. More specifically, the present invention relates to screen assemblies used in vibratory separators.

2. Description of Related Art

Vibratory screen separators with replaceable screen assemblies have long been known, and include a base, a resiliently mounted housing, a vibratory drive connected to the housing, and screen assemblies positioned on the housing. The screen assemblies are periodically replaced when process conditions dictate or when the performance of the screening media degrades due to abrasion, failure, or blinding. The screening media can be flat or pleated, single or multi-layered, laminated or un-laminated. Screen assemblies include screening media bonded to components structural in nature that are used to fasten or tension the screening media to a vibratory separator so that the motion of the separator is imparted to the screening media.

Flexible rectangular screen assemblies constructed by using structural components that form a "J" or similar shape on two sides of screen are known as hookstrip style screens. Hookstrip style screens are fastened to vibratory separators by pulling the screen assembly taut over a crowned deck. The "crown" or "radius" in the deck is necessary because the geometry of the crown keeps the flexible screen in contact with the vibrating deck without approaching tension levels that would damage the screening media.

Screen assemblies constructed by bonding screening media to rectangular structural frames that minimize the flexibility of the screen assembly are known as panel style screens. The structural frame may or may not have internal supporting cross members. Panel style screens are fastened to vibratory separators by clamping one or more surfaces of the structural frame to a mating surface (or deck) of the vibratory separator. The decks of vibratory separators that accept panel screens are noticeably less crowned than the decks of vibratory separators that accept hookstrip style screens, but the decks are usually slightly crowned to prevent panel style screens from flexing or chattering when the vibratory separator is in motion.

BRIEF SUMMARY OF THE INVENTION

The present invention is directed to screen assemblies for vibratory separators including a structural frame that is mounted in a vibratory separator into which a plurality of lightweight and flexible screen elements are inserted into multiple rows of perforated screen supports. The perforated screen supports are bonded to each other and to the structural frame. The perforated screen supports are aligned parallel to the direction in which solids are conveyed by the vibratory motion. The perforated screen supports are assembled to the structural frame so that unscreened material cannot substantially bypass the screening media. The cross sectional geometry of the perforated screen support and of the formed screen elements can be rectangular, triangular, half-circular, half-ellipsoid, catenary, hyperbola, or other similar geometric shape. The screen elements include one or more layers of screening media that may be bonded to each other and may be preformed to conform to the geometry of the perforated screen support.

The present invention substantially increases the available area for screening compared to the available area of the prior art when a screen assembly creates a flat or crowned screening surface on a vibratory separator. Furthermore, the ease of replacing small, (typically three inches wide and 24 inches long) and lightweight (typically less than one pound) individual screen elements in the present invention saves time and material by eliminating the periodic replacement of large, heavy, and cumbersome screen assemblies in conventional vibratory separators. Typically these conventional screen assemblies weigh anywhere from 20 to 50 pounds and are approximately two to three feet long and up to four feet wide. In addition, when the present invention is used to replace hookstrip style screens with crowned screening surfaces, the effective screening area is increased by channeling the flow of unscreened material and preventing the pooling of liquid on either side of a crown deck. The crowned screen deck causes the processed material to flow away from the center of the screen (the crown) towards the sides, causing a large area of the screen surface to be under-utilized. In addition, the present invention facilitates storage and shipping of replacement screen elements because small, lightweight screen elements are stored and shipped rather than large, heavy screen assemblies. Furthermore, the present invention minimizes environmental impact by minimizing or eliminating the waste presently generated from disposal of screen assemblies. The screen elements of the present invention are easily recycled because the screen elements may have only stainless steel metallic components. The present invention improves the safety and speed with which screen elements can be replaced because small, lightweight screen elements are pressed into place as opposed to handling cumbersome and heavy screen frames. The present invention improves the economics of vibratory screening by allowing the replacement of individual screen elements rather than replacing the entire screen assembly in the event of a localized screen failure.

The difference between the present invention and a prior invention (described in U.S. patent application Ser. No. 10/922,342) by some of the applicants of the present invention is the manner in which the screen elements are installed and held in the perforated screen supports on the support frame.

The prior invention teaches the support frame to have two substantially horizontal flanges extending inwards along the upper edges of the perforated screen support. The prior invention also teaches the screen element to be resilient and having slightly larger forming radius than the perforated screen support. In order to ensure a proper fit of the screen element into the perforated screen support, it is essential that the element is formed with larger radius than the perforated screen support and is resilient enough to allow it to expand in the perforated screen support to provide uniform sealing against the perforated screen support. The screen element is installed by placing one side of it under one of the flanges on the perforated screen support. Then the screen element is squeezed and pushed down into the perforated screen support and allowed to expand against the perforated screen support inner walls. Care must be exercised to ensure the other side of the screen element will go under the opposite flange of the perforated screen support. The screen element retention mechanism in the prior invention included small upward extensions at the end of the perforated screen support or the flanges on the perforated screen support having cut off sections to allow small tabs on the screen element sides to go into the cut off areas thereby preventing horizontal movement.

In contrast, the present invention describes a method of compressively holding the screen elements in the perforated screen supports and at the same time preventing any horizontal movement. The preferred screen element embodiment of the present invention includes a rigid frame formed to the inside diameter of the perforated screen support. The perforated screen support has an inwardly-extending flange on only one side. On the other side is a hold-down system that, when activated, pushes the screen element edge down and forces the screen element tightly against the inner surface of the perforated screen support. The inwardly-extending flange on the opposite side of the perforated screen support acts as a stop to prevent the screen element from climbing out of the perforated screen support. This greatly facilitates the removal and installation of the screen elements, and at the same time provides highly compressive hold down. This substantially eliminates potential process liquid bypass caused by loose fitting screen elements.

In a first aspect of the present invention, the geometry of the curve that forms the cross section of the perforated screen support and the screen element is selected to optimize the surface area available for screening, and to match the characteristics of the screening media to form fit. A semi-circular cross section is preferred, although other cross sectional profiles may be used.

In a second aspect to the present invention, the perforation pattern of the perforated screen support is selected to maximize the non-blanked area (area available for screening) and optimize the strength and rigidity of the finished product.

In a third aspect of the present invention, the design of the screen element is determined by the desired screening process. The screen element must be rigid and formed into a correct diameter so that it can be easily placed into the perforated screen support. The screen element may include a single layer of screening media or multiple layers of screening media. Multiple layer construction using two or three layers of screening media is preferable.

In a fourth aspect to the present invention, the perforation pattern of the screen support is selected to have an equal or larger open area than the screen element frame in order not to block any available open screening area on the screen element and to provide adequate support.

In a fifth aspect of the present invention, a screen retention mechanism prevents the movement of screen element within the perforated screen support and minimizes any motion dampening effects from looseness of the screen element within the perforated screen support. In an alternate preferred embodiment, a pneumatic or hydraulic system, rather than a mechanical system may be used.

In a further separate aspect of the present invention, the screen supports will be attached to a structural frame constructed of stainless steel or another corrosion resistant material that can be installed in existing vibratory screeners for long periods of time or permanently.

Because the screen elements are smaller, lighter and easier to install or change than the screen elements used on prior art vibrating screeners, operators may handle these with greater safety from injury.

The screen elements are easily recycled in cases where the elements can be constructed primarily of stainless steel and non metallic adhesives.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements.

DETAILED DESCRIPTION OF THE INVENTION

Before the subject invention is further described, it is to be understood that the invention is not limited to the particular embodiments of the invention described below, as variations of the particular embodiments may be made and still fall within the scope of the appended claims. It is also to be understood that the terminology employed is for the purpose of describing particular embodiments, and is not intended to be limiting. Instead, the scope of the present invention will be established by the appended claims.

In this specification and the appended claims, the singular forms "a," "an," and "the" include plural reference unless the context clearly dictates otherwise. Unless defined otherwise, all technical and scientific terms used herein have the same meaning as commonly understood to one of ordinary skill in the art to which this invention belongs.

Figure 1:
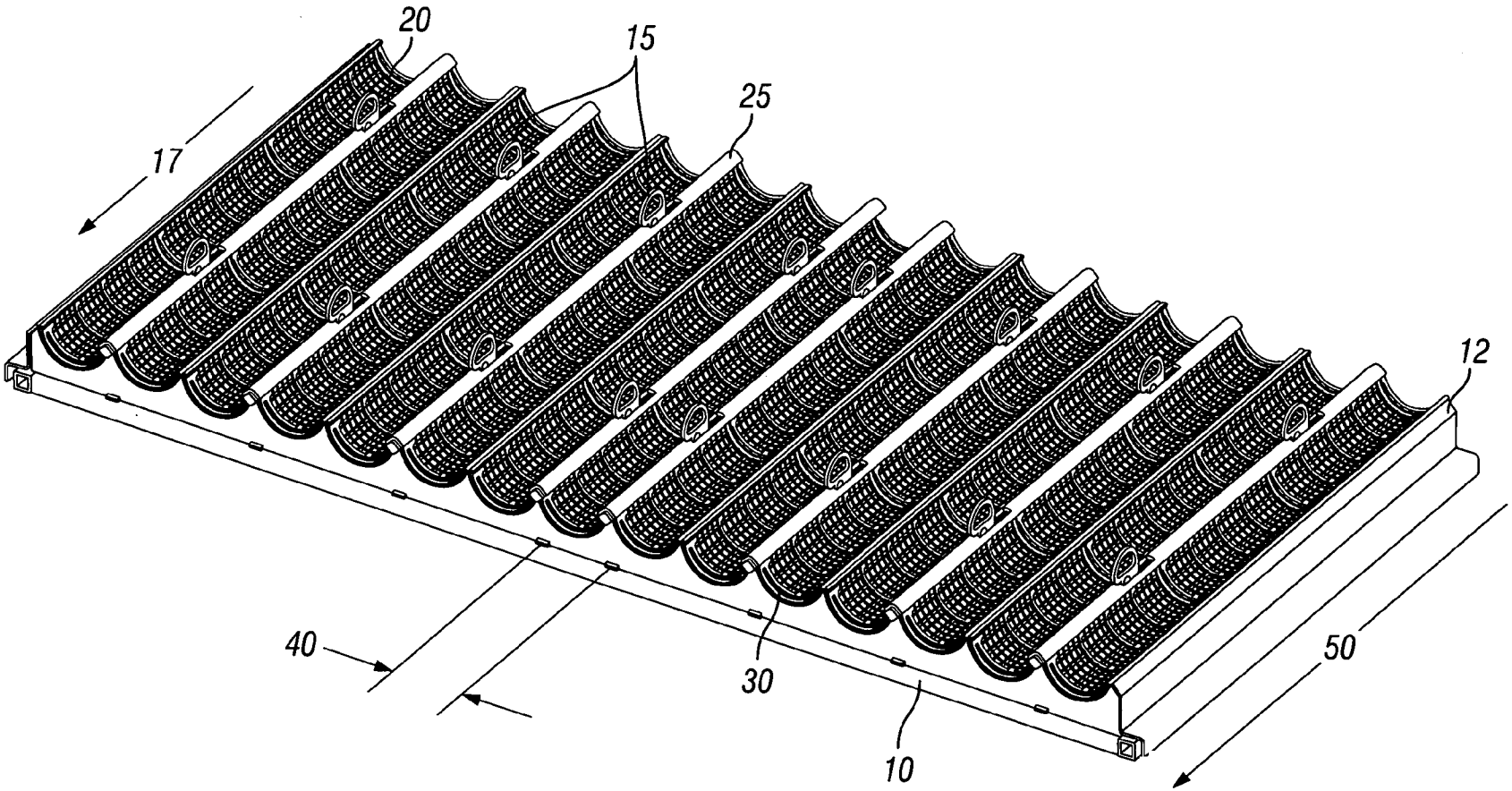
FIG. 1 is a screen assembly (12) constructed of multiple "U" shaped perforated screen supports for use on vibratory separators that accept Panel Style Screens.
Figure 3:
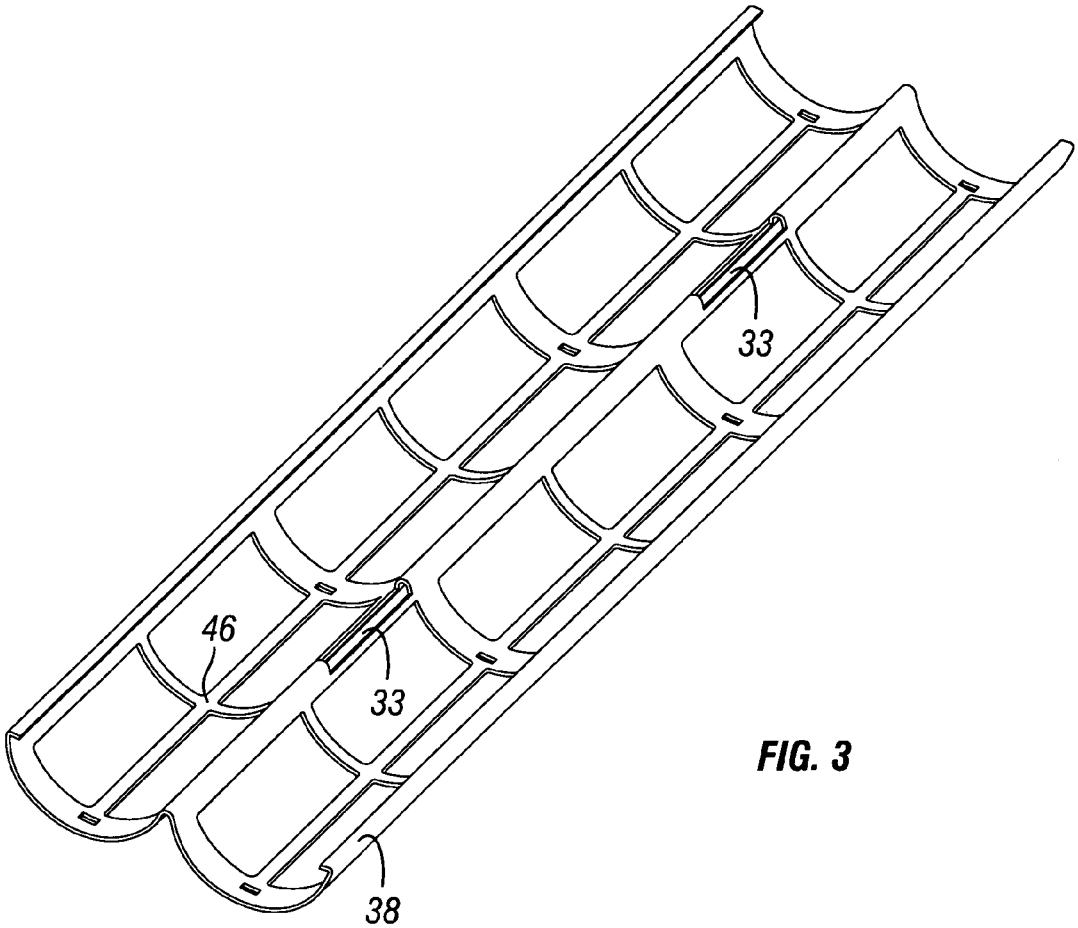
FIG. 3 is a double "U" shaped perforated screen support (38)
Figure 6A:
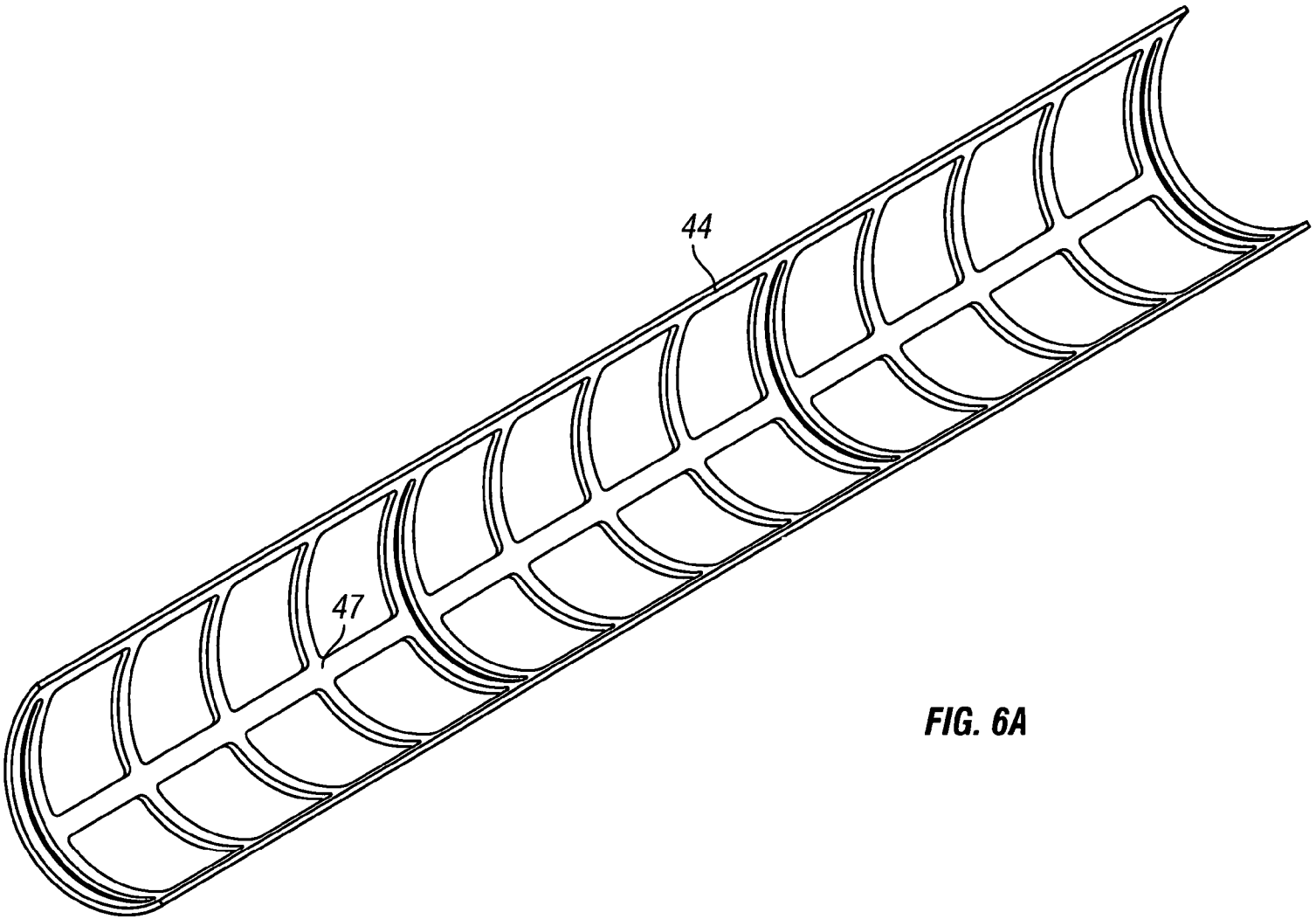
FIG. 6A is a view of the screen element frame (44) of the present invention.
Figure 6B:
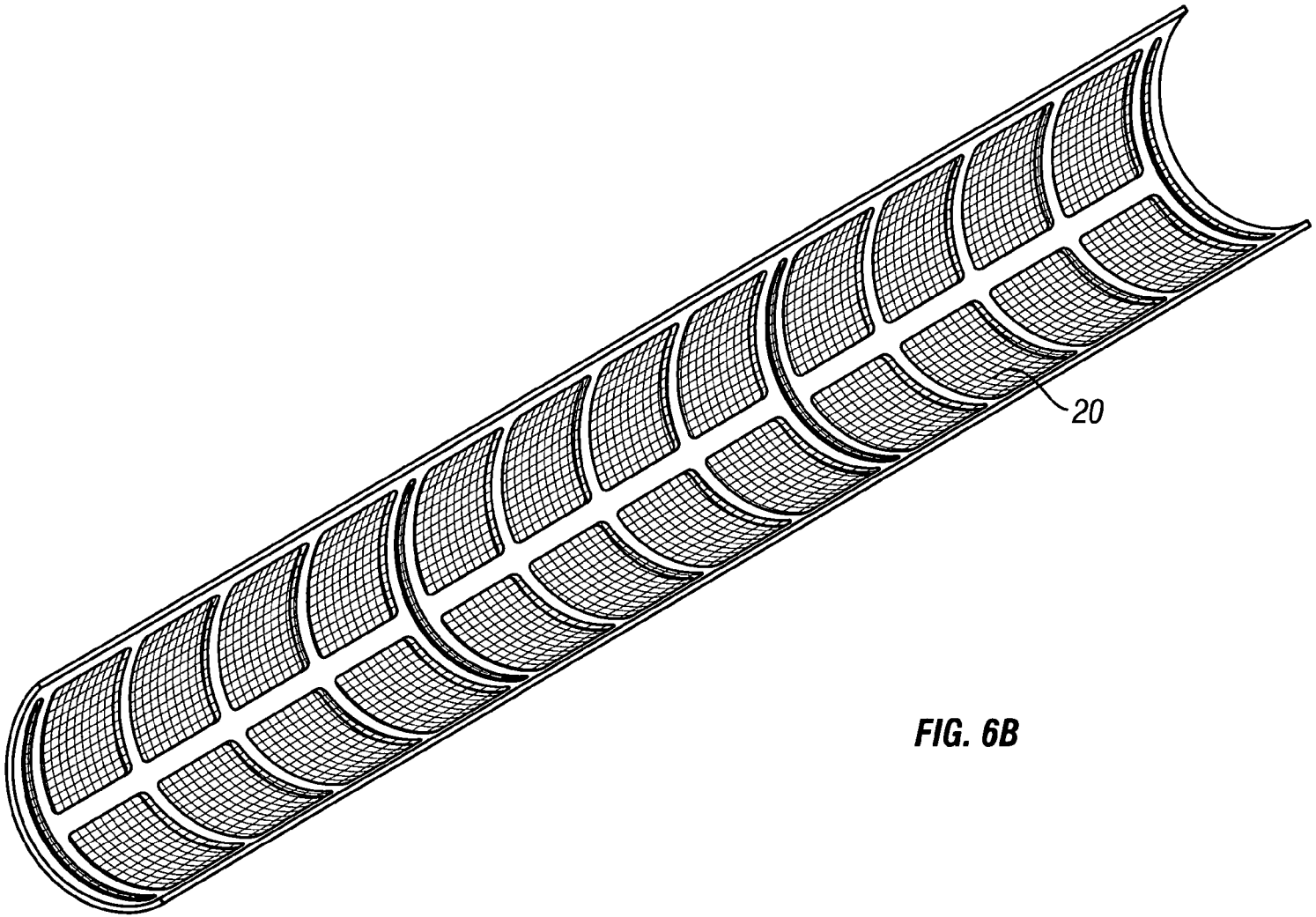
FIG. 6B is a view of the screen element (20) of the present invention.
Figure 8:
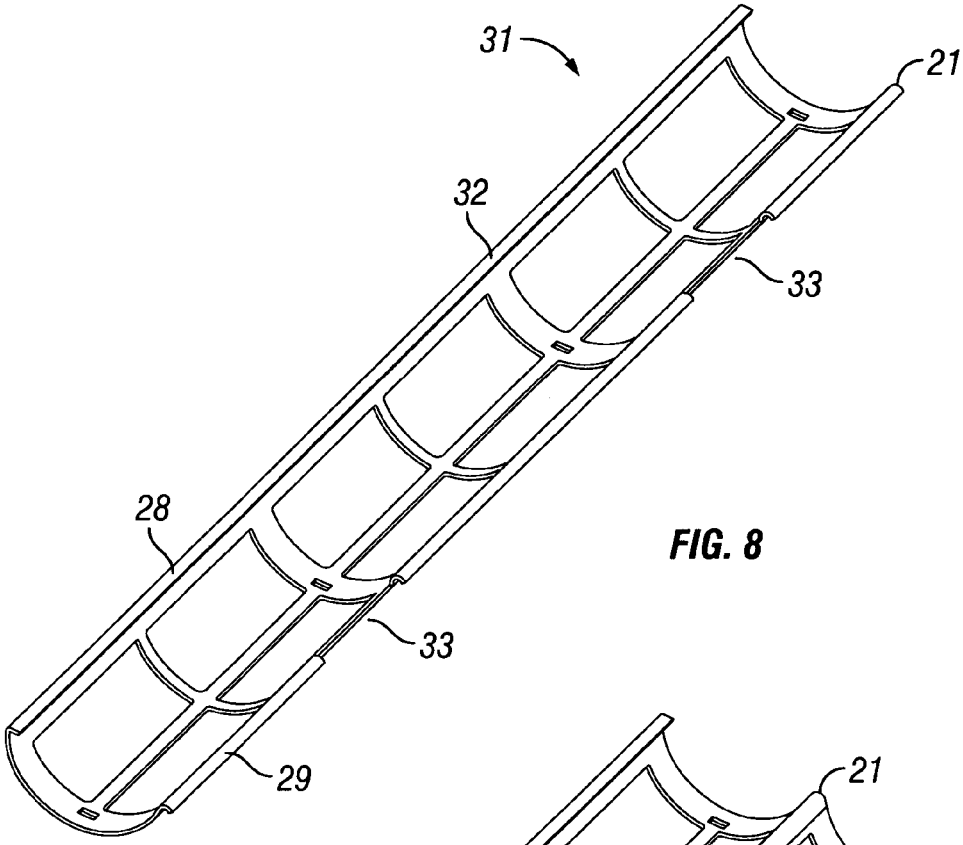
FIG. 8 illustrates the single "U" shaped perforated screen support (31)
Figure 9:
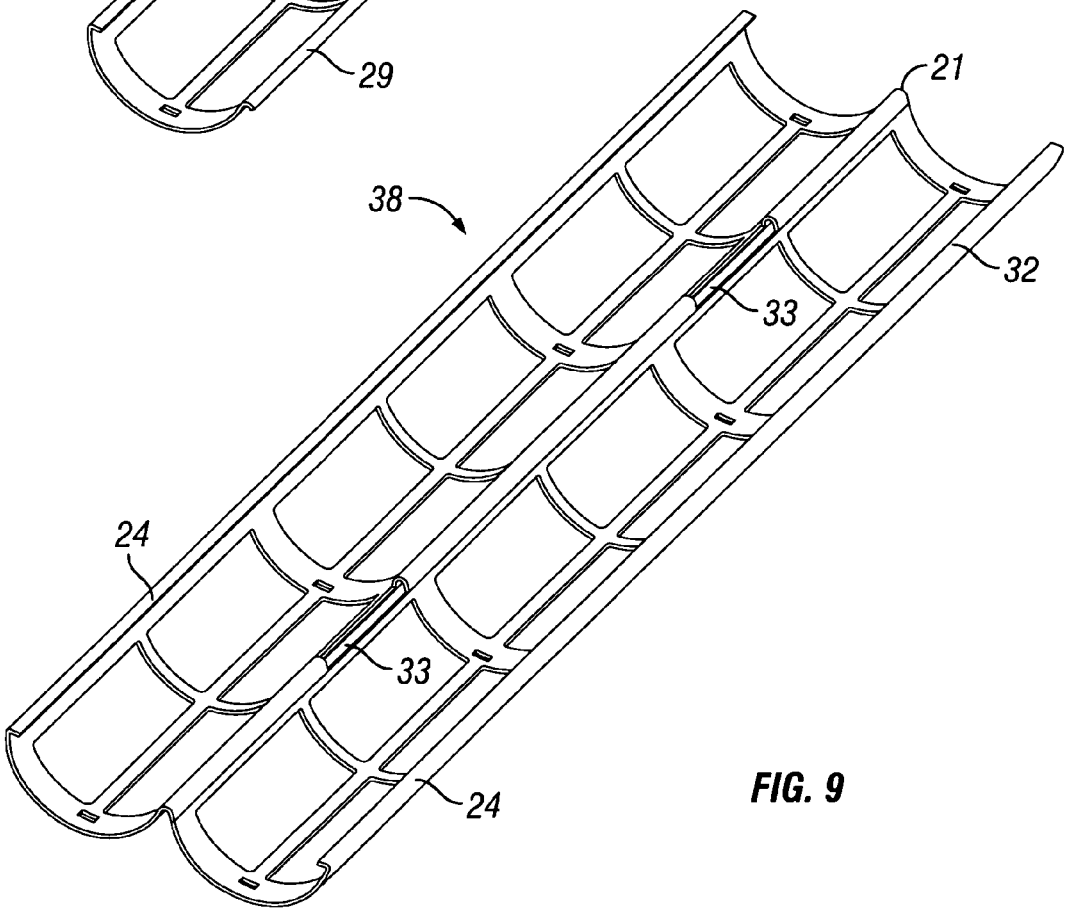
FIG. 9 illustrates the double "U" shaped perforated screen support (38)
Figure 10:
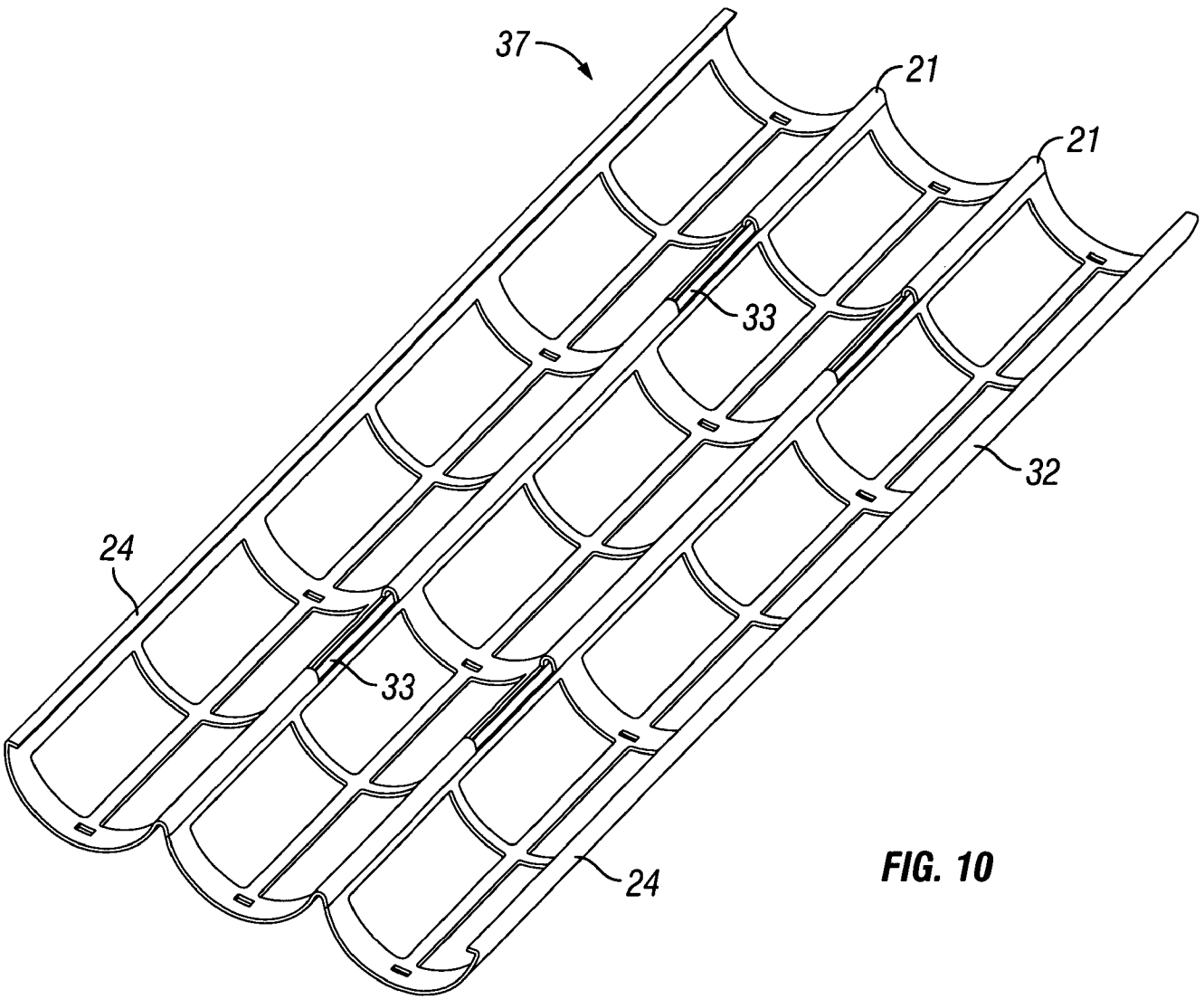
FIG. 10 illustrates the triple "U" shaped perforated screen support (37)
Figure 11:
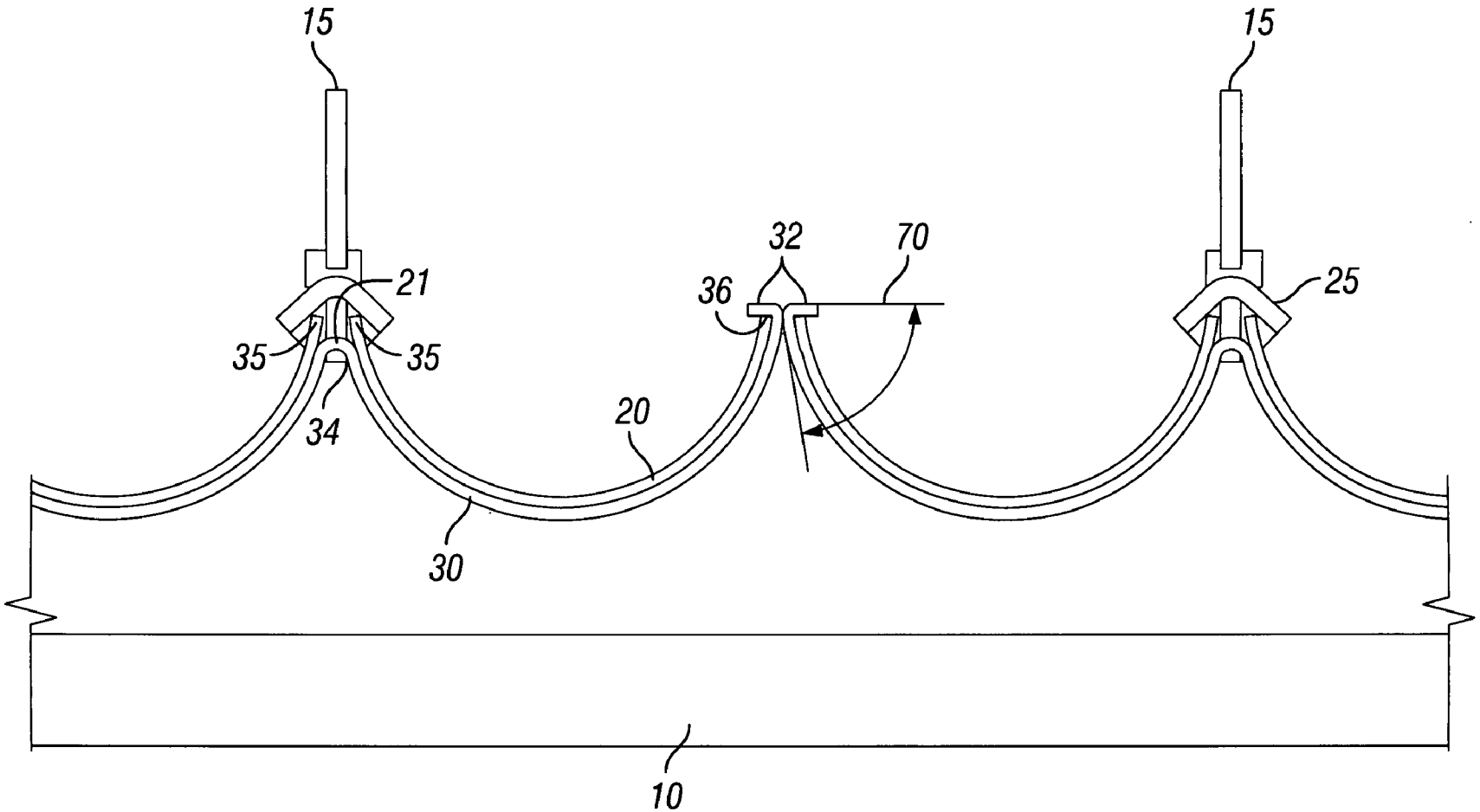
FIG. 11 is an end view of the screen element hold down system showing the support frame (10), "U" shaped perforated screen support (30), screen support flange (32), screen element sides (35) and (36), screen element (20), hold down bar (25) and hold down hook (15)

FIG. 1 illustrates a screen assembly (12) of a preferred embodiment of the present invention for use on vibratory separators that accept panel style screens. The screen assembly includes a structural support frame (10) for use with a panel style screen upon which multiple rows of "U" shaped perforated screen supports (30) are mounted. Into each "U" shaped perforated screen support (30), a screen element (20), as shown in FIG. 6B, would be inserted for screening (FIG. 11). The "U" shaped perforated screen supports (30) are constructed by shaping perforated sheet material or wedge wire into the desired cross sectional geometry. The perforation pattern (46), as shown in FIG. 3, is designed to have equal or larger open area than the perforation pattern (47) on the screen element frame (44), as shown in FIG. 6A. See U.S. patent application Ser. No. 10/922,342, filed Aug. 20, 2004 and U.S. Patent Provisional Application 60/839,141 filed Aug. 17, 2006 and U.S. Provisional Patent Application 60/838,565 filed Aug. 18, 2006 and incorporated herein by reference, for reference to the prior invention of the screen frame and screen, and for a technique to make screens used in the preferred embodiment. It is preferred to have a consistent cross sectional size along the entire length of the "U" shaped perforated screen support (30), rather than have it taper towards one end. The "U" shaped perforated screen supports (30) can be made in the form of single (31), double (38) or triple (37) "U" shaped perforated screen supports, as shown in FIGS. 8, 9, & 10. The purpose of the "U" shaped perforated screen supports (30) is primarily to confine, shape, and give support to screen element (20).

The direction arrow (17) in FIG. 1 indicates the direction that the reject or oversize solids (not shown) would be conveyed when the screen assembly (12) is in operation. The diameter or width (40) across the "U" shaped perforated screen support (30) can range from one-half inch to ten inches, and the length (50) of a "U" shaped perforated screen support (30) may be in the range of twelve inches to sixty inches as required to match the design of the vibratory separator (85). The use of a "U" shaped perforated screen support (30) of approximately three-inch width or diameter (40) is preferable because (a) the screen elements (20) are easy to handle, (b) a relatively low number of rows is needed to span most vibratory separators (85), and (c) the available surface area for screening media is significantly increased in comparison to a flat surface.

Figure 2:
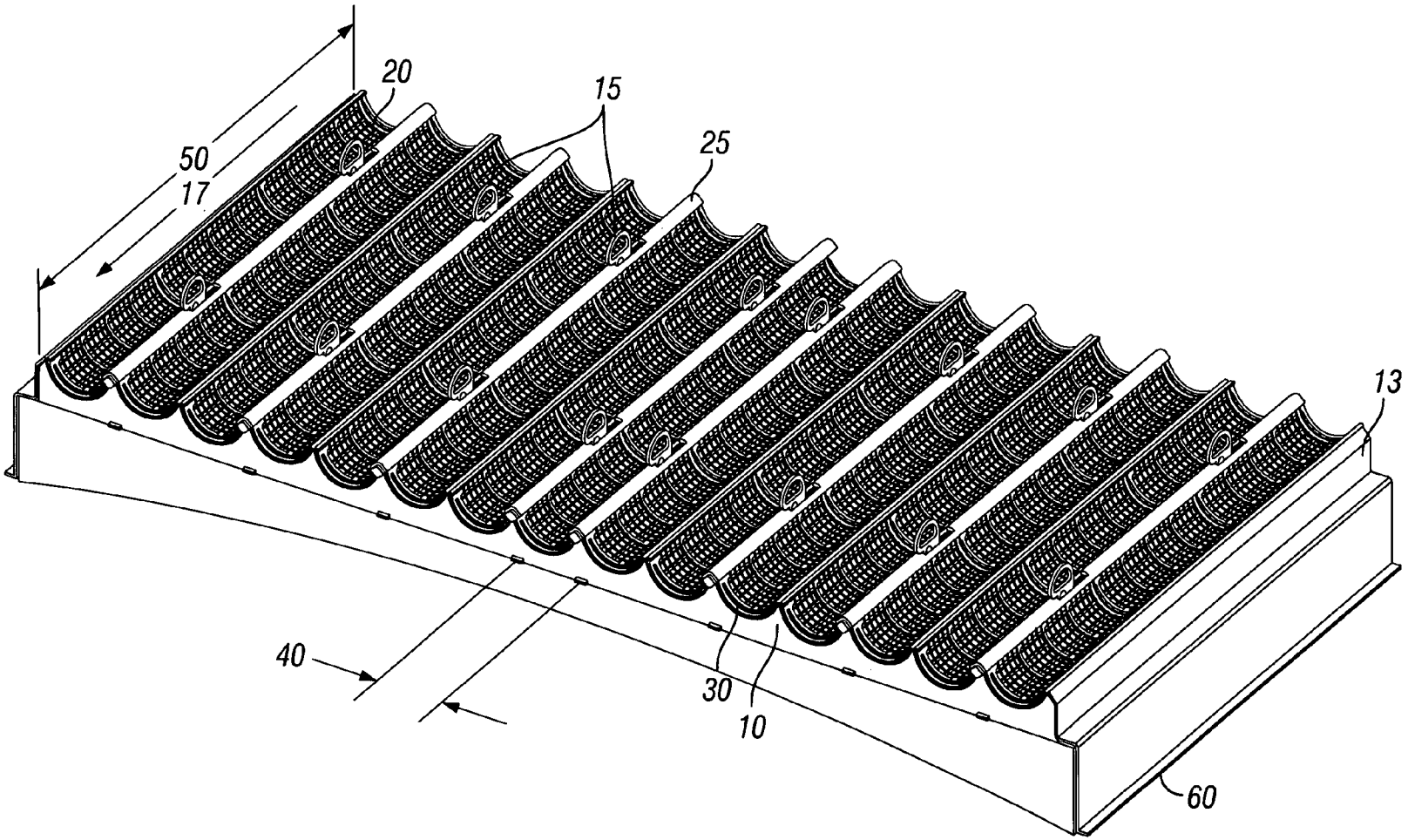
FIG. 2 is a screen assembly (13) constructed of multiple "U" shaped perforated screen supports for use on vibratory separators that accept Hookstrip Style Screens.

FIG. 2 illustrates a screen assembly (13) of a preferred embodiment of the present invention for use on vibratory separators that accept hook style screens well-known in the industry. The screen assembly (13) includes a structural component (60) upon which the support frame (10) is mounted. The purpose of the structural component (60) is to support the support frame (10) and allow the screen assembly (13) to fit over the crowned deck (not shown) of the vibratory separator commonly used in the same applications. The primary purpose of the "U" shaped perforated screen supports (30) is to confine, shape, and support the screening media or screen elements (20), as shown in FIG. 11. The direction arrow (17) in FIG. 2 indicates the direction that the reject solids (not shown) would be conveyed when the screen assembly (13) is in operation. The diameter or width (40) across the "U" shaped perforated screen supports (30) can range from one-half inch to ten inches, and the length (50) will be in the range of twelve inches to sixty inches as required to match the design of any type vibratory separator (85).

Figure 4:
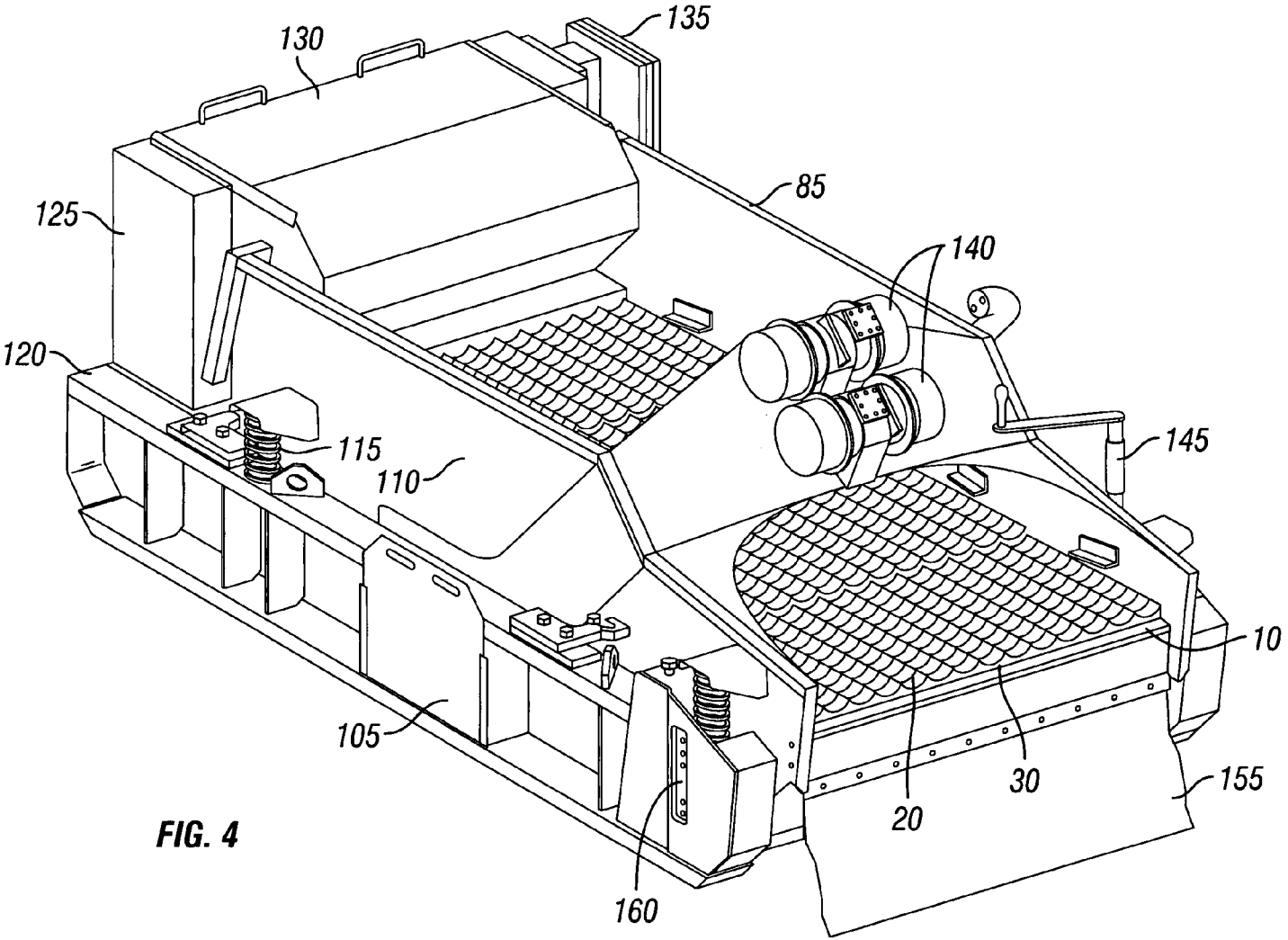
FIG. 4 is a view of a vibratory separator (85) with support frame (10) constructed of multiple "U" shaped perforated screen supports (30)
Figure 5:
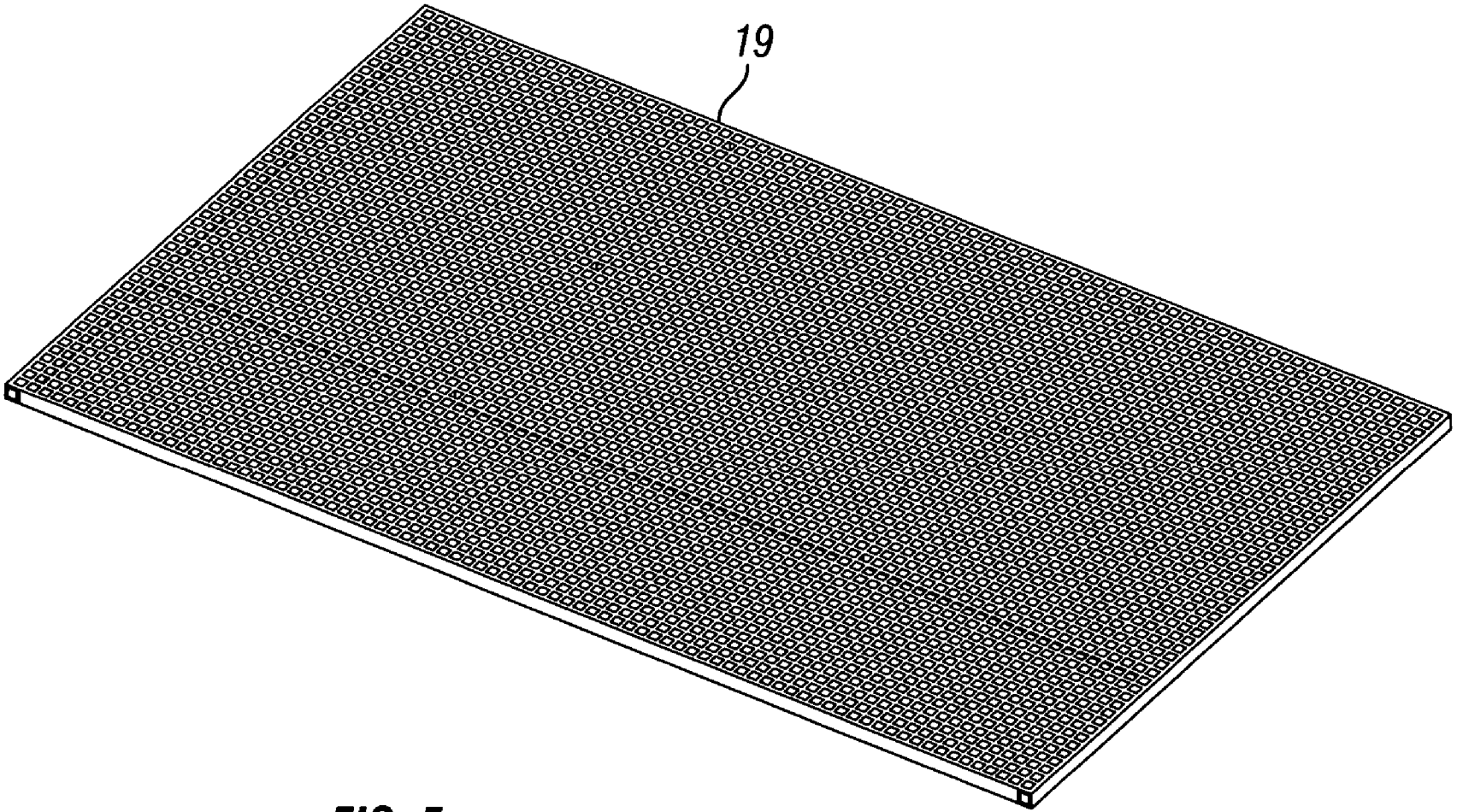
FIG. 5 is a side view of a formed non-pleated screen element (19) shown on the prior art.

FIG. 4 illustrates a vibratory separator (85) having a stationary base (120), vibrating screen deck (110), feed distributor (125), distributor cover (130), electrical control panel (135), vibrator motors (140), support springs (115), process liquid discharge gate (105), discharge skirt (155), screen deck level adjustment crank (145), level indicator (160), support frame (10), "U" shaped perforated screen supports (30) and screen elements (20).

FIG. 8 shows a single "U" shaped perforated screen support (31) having a first longitudinal edge (28) and second longitudinal edge (29), wherein the first and second longitudinal edges are parallel to and opposite one another. First longitudinal edge (28) of single "U" shaped perforated screen support (31) features inwardly-directed support flange (32) running along the length of the first longitudinal edge and formed across the top opening of the screen support (31) so that the angle (70) defined by the lower surface of the flange and the vertical tangent of the screen support (31) inner surface is in the range of 80 to 100 degrees. Obtuse angles are preferable because the resiliency of the screen element forces the screen to conform to the inner diameter of the screen support as the edge of the screen element slides against the lower flange as it uncoils after insertion and compression into the screen support (31). One skilled in the art will appreciate that support flange (32) need not be continuous along its entire length, so long as its intended function of restraining screen elements (20) is not compromised. Second longitudinal edge of single "U" shaped perforated screen support (31) features an outwardly-curving lip running along the length of the second longitudinal edge (29) and directed away from the inner curvature of the screen support (31), so forming a ridge (21). Ridge (21) is interrupted to create slots (33) to accommodate hold down hooks (15). The single "U" shaped perforated screen support (31) of FIG. 8 is designed to allow pairing with at least one other screen support. For example, second longitudinal edge (29) may abut a flush edge (not shown) of an adjoining screen support (30). Alternatively, one skilled in the art will appreciate that ridge (21) of single "U" shaped perforated screen support (31) may be modified to allow apposed screen support ridges from two adjoining screen supports to interlock (not shown), while preserving slots (33).

FIGS. 9 and 10 show double and triple "U" shaped perforated screen supports (38 and 37, respectively), with longitudinal edges (24). The double "U" shaped perforated screen support (38) has one ridge (21), while the triple "U" shaped perforated screen support (37) has two ridges (21). Longitudinal edges (24) of double and triple "U" shaped perforated screen supports (38, 37) feature inwardly-directed support flanges (32) running along the length of each longitudinal edge and formed across the top opening of each screen support (38, 37) so that the angle (70) defined by the lower surface of the flange and the vertical tangent of the screen support (38, 37) inner surface is in the range of 80 to 100 degrees. Obtuse angles are preferable because the resiliency of the screen element forces the screen to conform to the inner diameter of the screen support as the edge of the screen element slides against the lower flange as it uncoils after insertion and compression into the screen support (38, 37). One skilled in the art will appreciate that support flanges (32) need not be continuous along their entire length, so long as their intended function of restraining screen elements (20) is not compromised. Ridges (21) lie parallel to the longitudinal edges (24), and feature slots (33) that allow hold down hooks (15) to pass through.

FIG. 11 is an end view of a "U" shaped perforated screen support (30) with a screen element (20) installed. One screen support flange (32) is formed across the top opening of the "U" shaped perforated screen support (30) so that the angle (70) defined by lower surface of the flange and the vertical tangent of the trough inner surface is in the range of 80 to 100 degrees. The other side (34) of the "U" shaped perforated screen support (30) is formed into a ridge (21) providing a place for the hold down hook (15) and hold down bar (21) to be located (FIGS. 9 & 10).

Figure 7A:
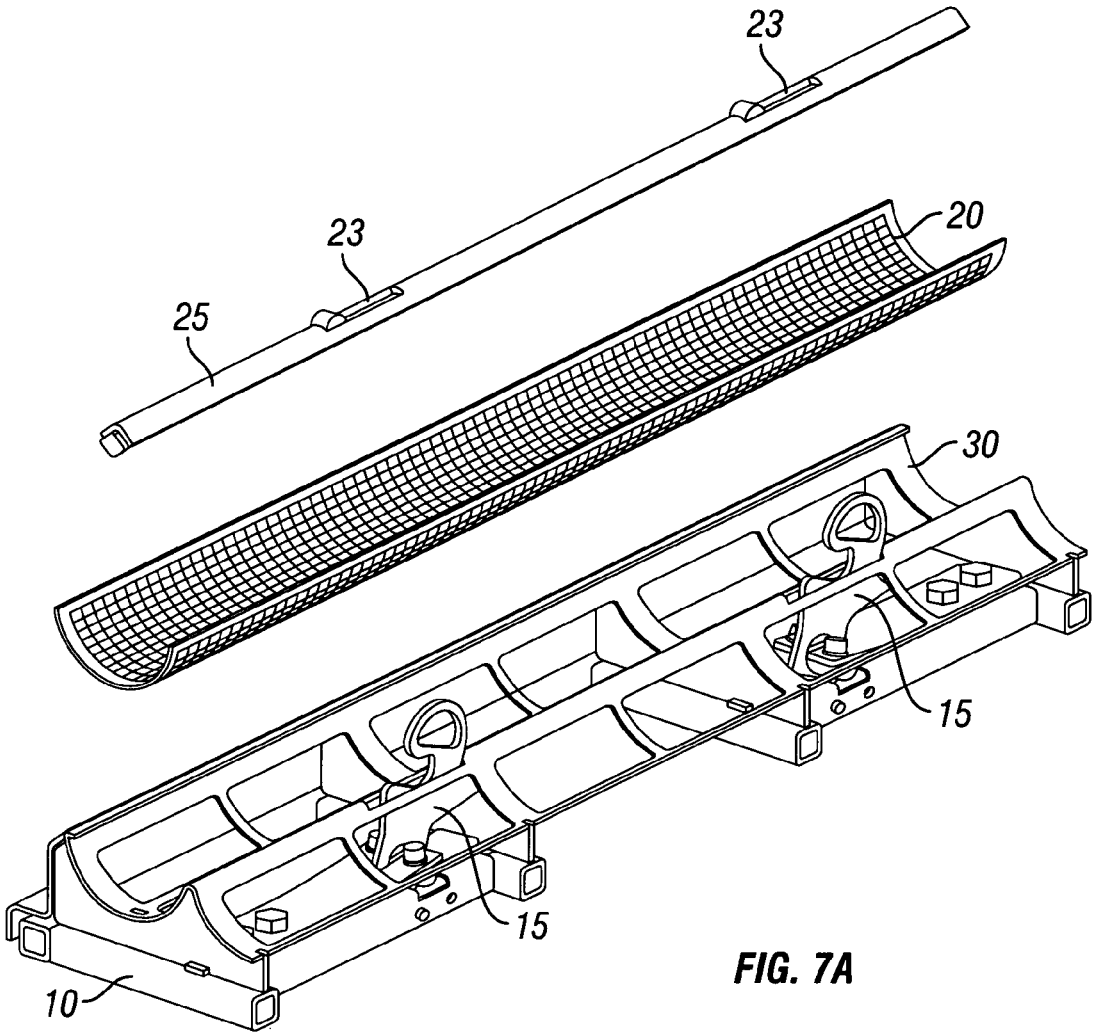
FIG. 7A illustrates by an exploded view the process of installing a screen into the perforated supports through the top opening of the support.
Figure 7B:
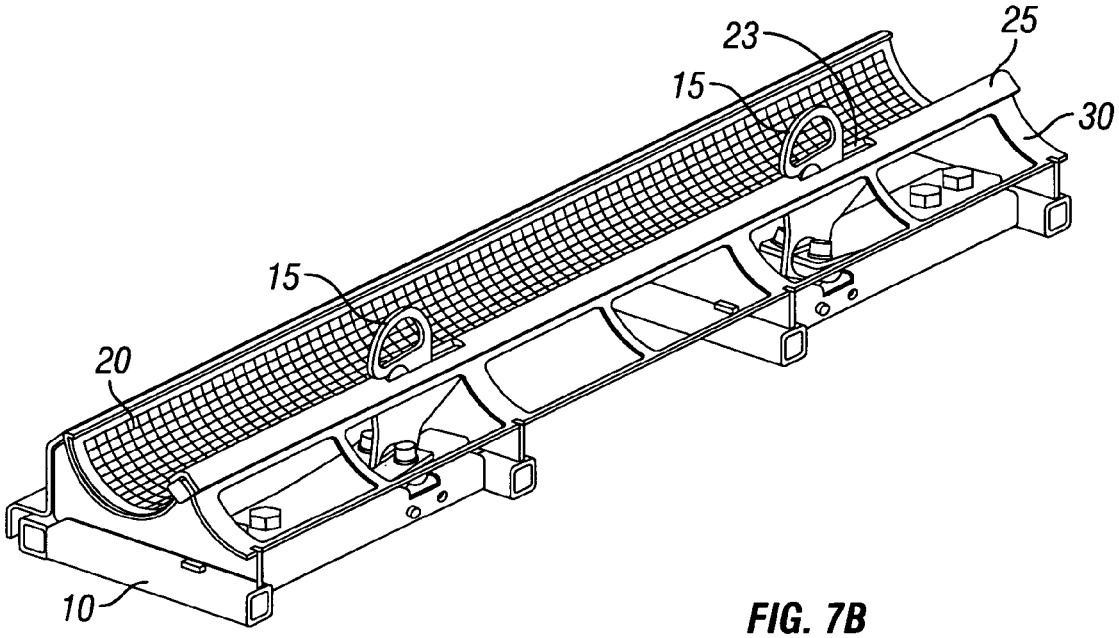
FIG. 7B illustrates the assembled screen element retention method.
Figure 7C:
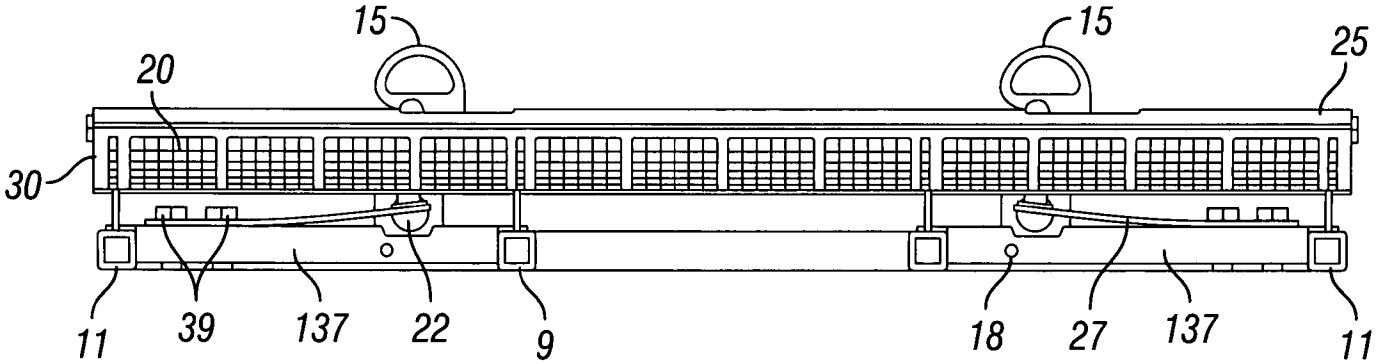
FIG. 7C illustrates the assembled screen element hold down system components.

FIGS. 7A, 7B, 7C, 7D and 7E illustrate the screen element hold down system operation. FIG. 7A shows the support frame (10) with "U" shaped perforated screen supports (30) attached to it, preferably by means of welding (not shown). FIG. 7A also shows screen element (20), a hold down bar (25) with slots (23) therein, and hold down hooks (15) to pass through slots (23) and hold down the hold down bar (25). FIG. 7B illustrates how the components go together as discussed below. FIG. 7C illustrates most of the components associated with the hold down system.

Figure 13A:
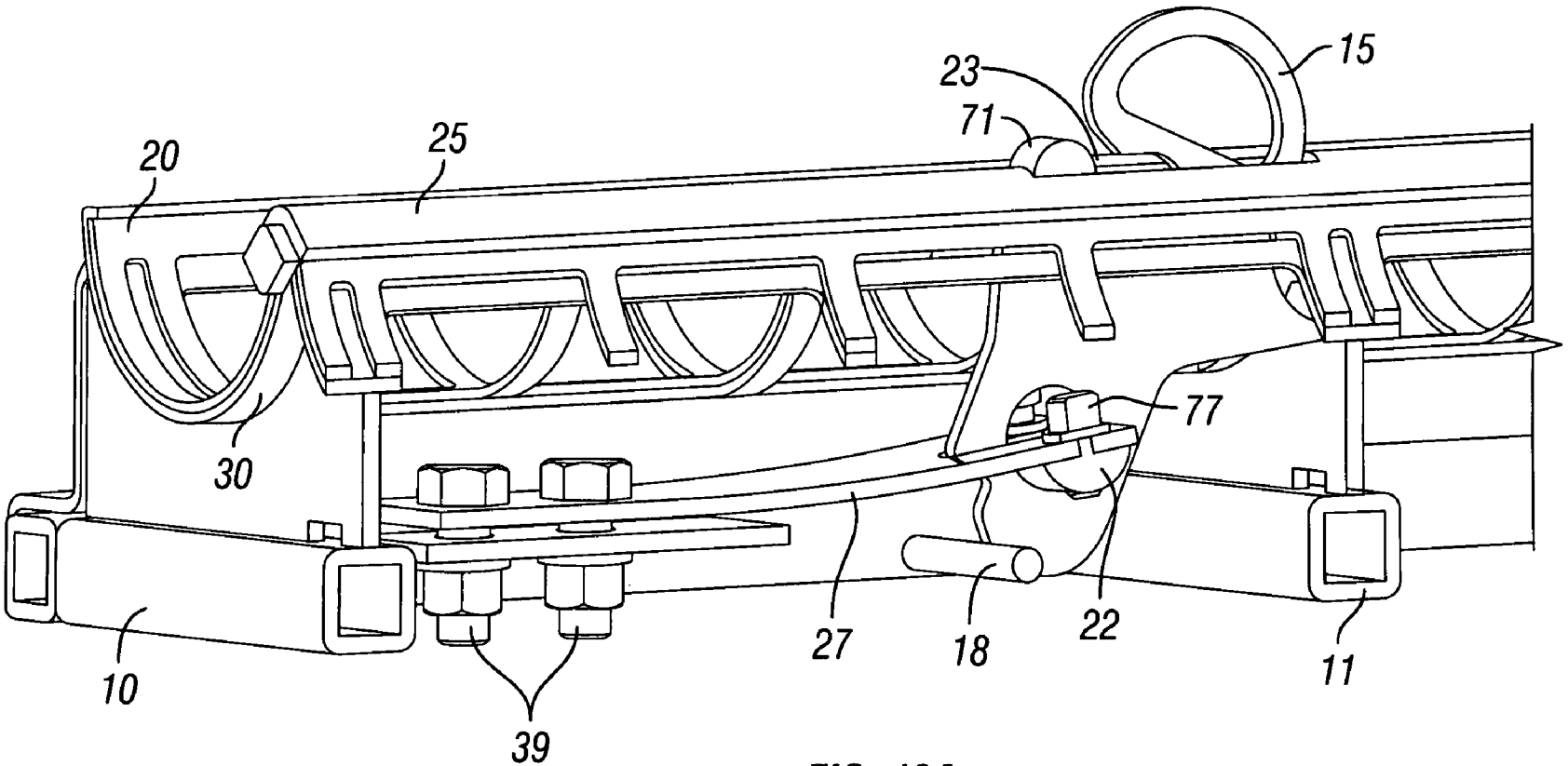
FIG. 13A shows the screen element hold down system in open position.
Figure 13B:
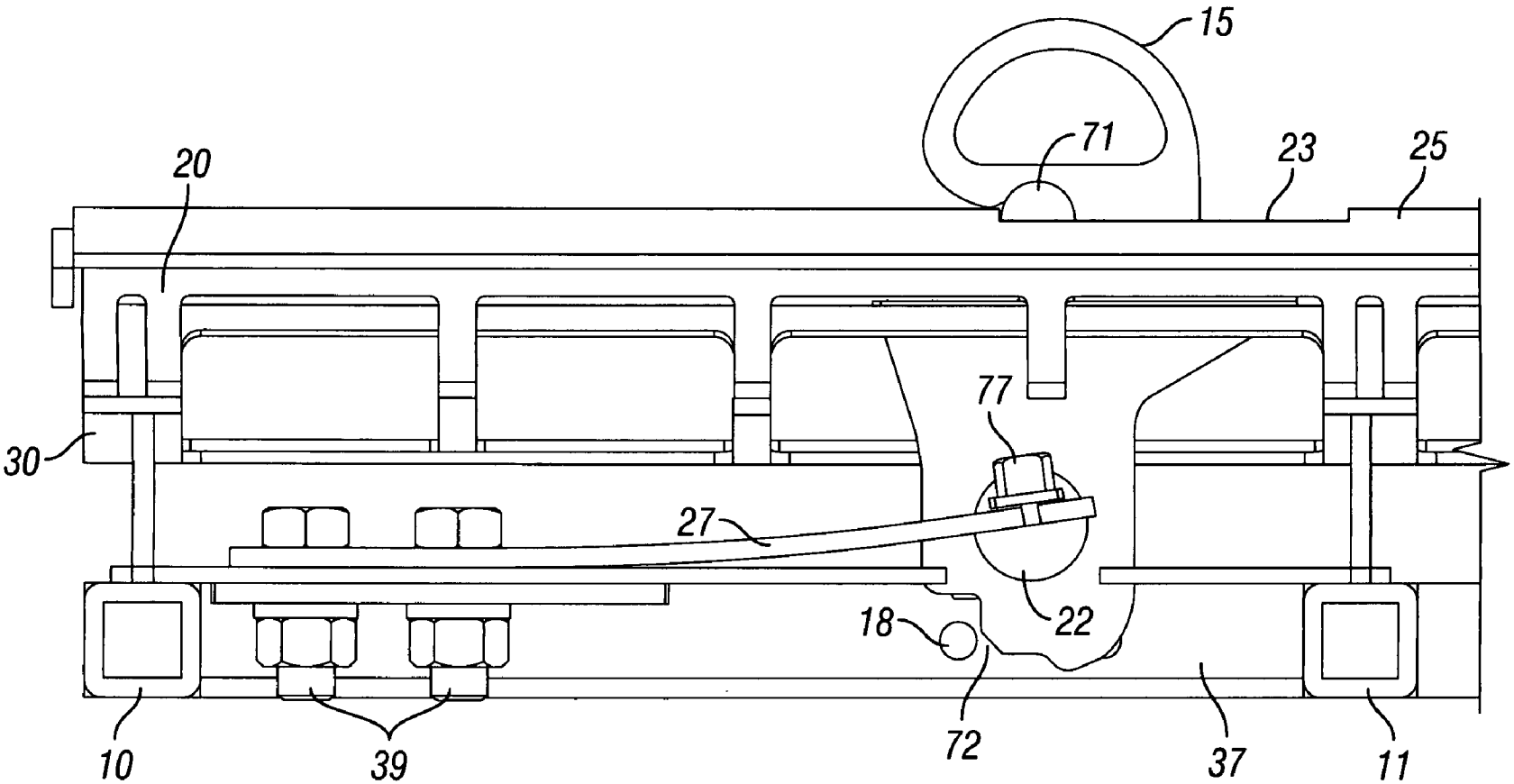
FIG. 13B shows the screen element hold down system in closed position

As shown by FIGS. 7C, 13A, and 13B, hold down hooks (15) are attached on the leaf spring (27) via a semi round pin (22) and screws (77), allowing the hold down hooks (15) to rotate relative to the semi round pin (22). Bolts (39) hold the leaf spring (27) on a support bar (137). Support bars (137) are welded to the support frame (10) between the end supports (11) and center supports (9), with end support (11) being slightly longer than center support (9). The "U" shaped perforated screen support (30) is bonded to the support frame (10), and the hold down hooks (15) are positioned between two "U" shaped perforated screen supports (30). Adjacent "U" shaped perforated screen supports (30) have slots (33) between one other to allow the hold down hooks (15) to be inserted through the slots (33), as seen in FIGS. 8, 9, 10.

Figure 7D:
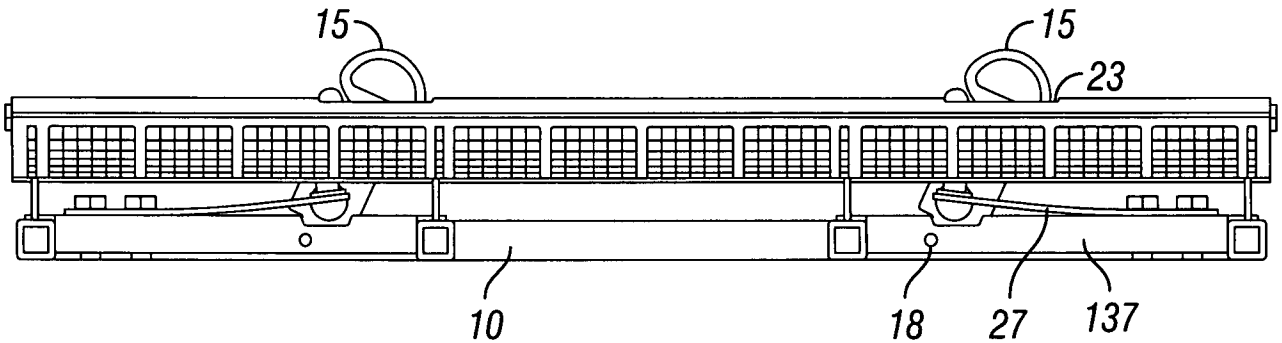
FIG. 7D illustrates the assembled screen element hold down system release.

Round pins (18) are placed through every support (137), and located under the hold down hooks (15) to act as stops for the hold down hooks (15) when the hooks are in an open position, as shown in FIGS. 7D and 13A. FIGS. 7C and 13B show the hold down hooks (15) in a locked position, resting on the hold down bar (25), and the leaf springs (27) pulling the hold down hooks (15) down. FIG. 11 illustrates how the screen elements (20) have been placed into the "U" shaped perforated screen supports (30) with the "U" shaped perforated screen supports (30) having screen support flanges (32) juxtaposed to one another. The hold down hooks (15) are passed through the slots (23) on the hold down bar (25) and the slots (33) on the "U" shaped perforated screen supports (30). The hold down bar (25) is placed on top of two adjacent screen element sides (35). The opposite screen element side (36) of the screen element (20) is placed under the screen support flange (32) on the "U" shaped perforated screen supports (30).

As shown in FIGS. 13A and 13B, when the hold down bar (25) is forced downwards by the spring (27) and the hold down hook (15), the screen elements (20) are forced against the bottom of the "U" shaped perforated screen support (30), and the screen element side (36) of the screen element (20) is forced against the screen support flange (32). The screen elements (20) are compressively held in the "U" shaped perforated screen supports (30) to prevent premature failures due to the screen element (20) movement under vibration.

Figure 7E:
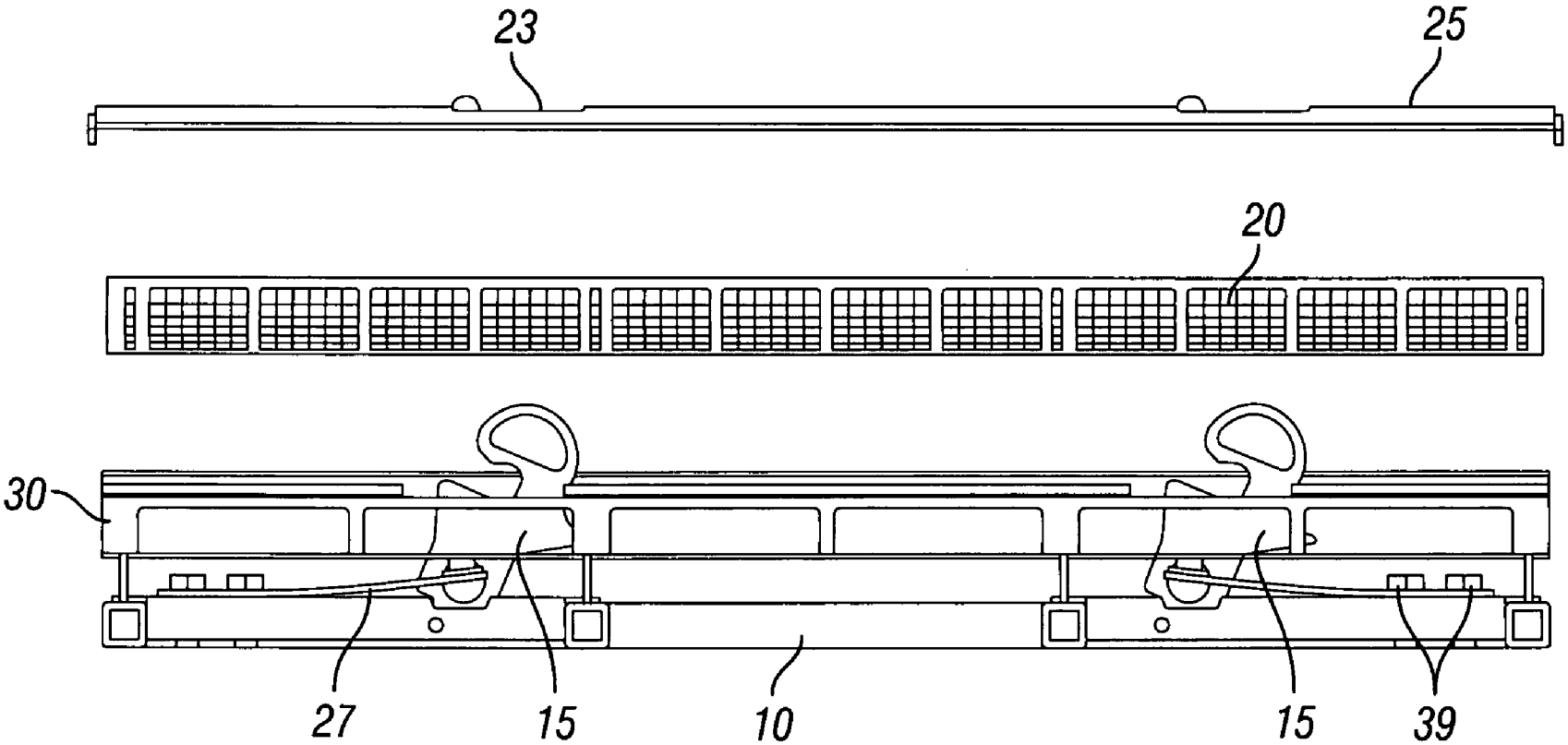
FIG. 7E illustrates the exploded view of the removal of the screen element from the screen support.

FIGS. 7D, 7E and 13A illustrate the operation of the hold down hooks (15) to release the hold down bars (25), thus allowing the screen element (20) to be removed from the "U" shaped perforated screen support (30) and replaced. The hold down hooks (15) are rotated into an open position, as shown in FIGS. 7A, 7D, 7E, 12, and 13A, where the hook rests on the round pin (18). The location of the round pin (18) keeps the hold down hook (15) in an open position, and prevents it from being pulled downwards by the leaf spring (27). Moving the hold down hooks (15) into this position allows them to pass through the slots (23) on the hold down bar (25) and the hold down bar (25) to be removed. The screen element (20) can now be removed from the "U" shaped perforated screen support (30) by passing the hold down hooks (15) through the slots (33).

Figure 12:
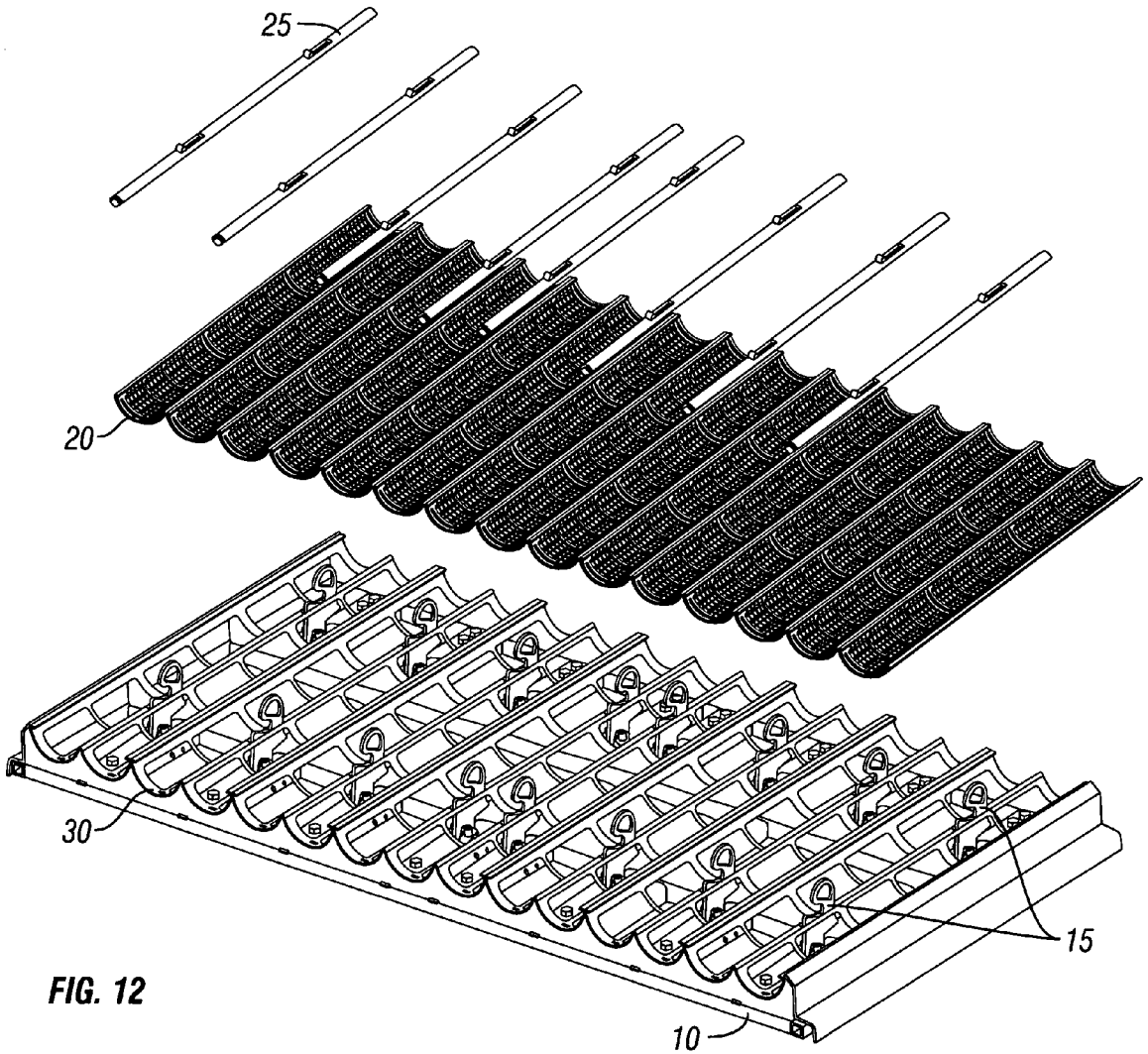
FIG. 12 shows a complete exploded assembly of the screen elements into the perforated supports on the frame. Support frame (10), "U" shaped perforated screen support (30), screen element (20), hold down bat (25) and hold down hooks (15)

FIG. 12 illustrates how the screen elements (20) are placed into the "U" shaped perforated screen supports (30) on the support frame (10), and FIG. 13B illustrates the operation of the hold down hook (15), which provides downward pressure on the hold down bar (25). With the hold down hooks (15) in open position and the hold down bars (25) removed, screen elements (20) are placed into the "U" shaped perforated screen supports (30) by sliding the screen element sides (36) of the screen elements under the screen support flanges (32) on the "U" shaped perforated screen supports (30), as seen in FIGS. 11 and 12. The hold down bars (25) are then placed over the hold down hooks (15) and lowered on the screen element sides (35), as shown by FIG. 11. One hold down bar (25) will always hold down two screen elements (20) at the same time. The hold down hooks (15) can now be rotated into a closed position over the semi round thrust pin (71), as shown in FIGS. 7B, 7C, and 13B. When the hold down hooks (15) are rotated over the semi round thrust pin (71), the bottom corner (72) of the hold down hooks (15) will slide off the semi round thrust pin (71), allowing the leaf spring (27) to pull down the hold down hook (15) without restriction.

By "operably linked" is meant that components (e.g., support frame, screen supports, hold down bar, hold down hooks, and screen elements) are placed into a functional relationship with one another. For example, by placing hold down hooks (15) into a closed position, hold down hooks (15) can be operably linked to screen supports (30), hold down bar (25), and at least one screen element (20) when, by placing hold down hooks (15) in open or closed position, they release or constrain, respectively, hold down bar (25) and at least one screen element (20).

In a first aspect of the present invention, and as shown in FIG. 7C, a screen retention mechanism comprising the hold down hooks (15), leaf springs (27), semi round pins (22), round pins (18) and a hold down bar (25) prevents the movement of screen element (20) within the "U" shaped perforated screen support (30) by compressively holding the screen element (20) against the "U" shaped perforated screen support (30).

In a second aspect of the present invention, the screen retention mechanism provides adequate force to hold the screen element (20) tightly against the "U" shaped perforated screen support (30) to prevent process liquid bypass (FIG. 7B).

In a third aspect of the present invention, the screen retention mechanism facilitates the removal of the screen element (20) from the "U" shaped perforated screen support (30) by moving the hold down hooks (15) into an open position, as shown by FIGS. 7D, 7E and 13A, removing the hold down bar (25), and lifting off the screen elements (20).

TABLE 1

| Listing of Components | |
|---|---|
| 9 | center support |
| 10 | support frame |
| 11 | end support |
| 12 | screen assembly |
| 13 | screen assembly |
| 15 | hold down hook |
| 17 | direction arrow |
| 18 | round pin |
| 19 | formed non-pleated screen element |
| 20 | screen element |
| 21 | ridge |
| 22 | semi round pin |
| 23 | slot |
| 24 | longitudinal edge |
| 25 | hold down bar |
| 27 | leaf spring |
| 28 | first longitudinal edge |
| 29 | second longitudinal edge |
| 30 | "U" shaped perforated screen supports |
| 31 | single "U" shaped perforated screen support |
| 32 | support frame flange |
| 33 | slot |
| 34 | other side of "U" shaped perforated screen support |
| 35 | screen element sides |
| 36 | screen element side |
| 37 | triple "U" shaped perforated screen support |
| 38 | double "U" shaped perforated screen support |
| 39 | bolts |
| 40 | diameter or width |
| 44 | screen element frame |
| 46 | perforation pattern |
| 47 | perforation pattern |
| 50 | length |
| 60 | structural component |
| 70 | angle |
| 71 | semi round thrust pin |
| 72 | bottom corner |
| 77 | screws |
| 85 | vibratory separator |
| 105 | process liquid discharge gate |
| 110 | vibrating screen deck |
| 115 | support springs |
| 120 | stationary base |
| 125 | feed distributor |
| 130 | distributor cover |
| 135 | electrical control panel |
| 137 | support bar |
| 140 | vibrator motors |
| 145 | screen deck level adjustment crank |

TABLE 1-continued

| Listing of Components | |
|---|---|
| 155 | discharge skirt |
| 160 | level indicator |

Because many varying and different embodiments may be made within the scope of the invention concept taught herein which may involve many modifications in the embodiments herein detailed in accordance with the descriptive requirements of the law, it is to be understood that the details herein are to be interpreted as illustrative and not in a limiting sense.

All references cited in this specification are herein incorporated by reference as though each reference was specifically and individually indicated to be incorporated by reference. The citation of any reference is for its disclosure prior to the filing date and should not be construed as an admission that the present invention is not entitled to antedate such reference by virtue of prior invention.

It will be understood that each of the elements described above, or two or more together may also find a useful application in other types of methods differing from the type described above. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention set forth in the appended claims. The foregoing embodiments are presented by way of example only; the scope of the present invention is to be limited only by the following claims.

The invention claimed is:

1. A screen assembly for use with a vibratory separator to screen material and convey solids, comprising:

a) a frame, said frame mounted in the vibratory separator;

b) a set of perforated curved screen supports, said screen supports being bonded to said frame and said screen supports are aligned parallel to the direction of the conveyance of the solids;

c) at least one curved screen element mounted on at least one of said screen supports;

d) a blocking mechanism to block outward movement of said at least one screen element, wherein said blocking mechanism includes a screen support flange formed along the top opening of one side of the screen support, at least one ridge, said ridge lying across the opening of the screen support from the screen support flange, aligned parallel to the direction of the conveyance of the solids, and featuring at least one slot, a hold down bar oriented along said at least one ridge over a first edge of said at least one screen element, said hold down bar featuring at least one slot corresponding to the at least one slot of the at least one ridge, and at least one hold down hook inserted through said at least one slot of at least one ridge, through said at least one slot of at least one hold down bar, wherein said hold down hook is configured to rotate about a horizontal axis through a first pin attached with said frame perpendicular to the direction of the conveyance of the solids, wherein said hold down hook is rotationally operable with said frame so that said hold down hook may rotate between an open position allowing outward movement of said hold down bar and said at least one screen element and a closed position blocking outward movement of said hold down bar and said at least one screen element.

2. The screen assembly of claim 1, wherein said flange forms an angle in the range of 80° to 100° defined by the lower surface of said flange and the vertical tangent of said screen support inner surface.

3. The screen assembly of claim 1, wherein said flange forms an obtuse angle, said angle defined by the lower surface of said flange and the vertical tangent of said screen support inner surface.

4. The screen assembly of claim 1, wherein said first pin is semi-round, and wherein said hook is held on said first pin between two screws.

5. The screen assembly of claim 1, wherein placement of said at least one hold down hook into a closed position compresses said hold down bar and said at least one screen element between said at least one hold down bar and said ridge.

6. The screen assembly of claim 5, wherein outward movement of said at least one screen element is restricted when said at least one hold down hook is in the closed position.

7. The screen assembly of claim 6, wherein placement of said at least one hold down hook into an open position releases said hold down bar and said at least one screen element from between said at least one hold down bar and said ridge.

8. The screen assembly of claim 7, wherein said set of perforated screen supports is comprised of single "U" shaped perforated screen supports.

9. The screen assembly of claim 7, wherein said set of perforated screen supports is comprised of double "U" shaped perforated screen supports.

10. The screen assembly of claim 7, wherein said set of perforated screen supports is comprised of triple "U" shaped perforated screen supports.

11. The screen assembly of claim 7, wherein said set of perforated screen supports is comprised of single and double "U" shaped perforated screen supports.

12. The screen assembly of claim 7, wherein said set of perforated screen supports is comprised of single and triple "U" shaped perforated screen supports.

13. The screen assembly of claim 7, wherein said set of perforated screen supports is comprised of double and triple "U" shaped perforated screen supports.

14. The screen assembly of claim 7, wherein said hold down bar is configured to resist outward movement of said first edge of said at least one screen element away from said screen support when said hook is in said closed position, and wherein said flange is configured to resist outward movement of a second edge of said at least one screen element away from said screen support when said hook is in said closed position.

15. The screen assembly of claim 14, wherein said hold down hook is rotationally attached to a first end of a leaf spring with said first pin, wherein a second end of said leaf spring is fixedly mounted with said frame, wherein said leaf spring is configured to resist rotation of said hook to said open position, and wherein said leaf spring is configured to urge rotation of said hook to said closed position.

16. The screen assembly of claim 15, further comprising a second pin attached with said frame perpendicular to the direction of the conveyance of the solids, wherein said second pin is configured to contact said hook when said hook is in said open position, and wherein said second pin is configured to resist said leaf spring from moving said hook to said closed position when said hook is in contract with said second pin.

17. A screen assembly for use with a vibratory separator to screen material and convey solids, comprising:

a frame mounted with the vibratory separator;

a perforated screen support comprising a first "U" shaped support and a second "U" shaped support, a ridge between said first and second "U" shaped supports, an inwardly directed first flange on an edge of said first "U" shaped support across from said ridge, and an inwardly directed second flange on an edge of said second "U" shaped support across from said ridge, wherein said perforated screen support is attached to said frame and aligned parallel lengthwise to the direction of the conveyance of the solids, and wherein said ridge having a ridge slot;

a first screen element disposed on said first "U" shaped support and a second screen element disposed on said second "U" shaped support, wherein said first and second screen elements are each configured to be "U" shaped;

a hold down bar positioned on said ridge over an edge of said first screen element and an edge of said second screen element, and wherein said hold down bar has a bar slot aligned with said ridge slot; and a hold down hook rotationally mounted with said frame about a horizontal axis perpendicular to the direction of the conveyance of solids, wherein said hold down hook is disposed through said bar slot and said ridge slot, wherein said hold down hook is movable between an open position not blocking outward movement of said hold down bar and said first and second screen elements, and a closed position blocking outward movement of said hold down bar and said first and second screen elements.

18. The screen assembly of claim 17, wherein said first screen element is compressively held in place adjacent to said screen support by said hold down bar and said first flange when said hook is in said closed position, and wherein said second screen element is compressively held in place adjacent to said screen support by said hold down bar and said second flange when said hook is in said closed position.

19. The screen assembly of claim 18, wherein said hold down hook is rotationally attached to a first end of a leaf spring with a first pin, wherein a second end of said leaf spring is fixedly mounted with said frame, wherein said hold down hook is rotationally operable with said frame so that said hold down hook may rotate about a horizontal axis through said first pin between said open position and said closed position, and wherein said leaf spring is configured to resist rotation of said hook to said open position and to urge rotation of said hook to said closed position.

20. The screen assembly of claim 19, further comprising a second pin attached with said frame perpendicular to the direction of the conveyance of the solids, wherein said second pin is configured to contact said hook when said hook is in said open position, and wherein said second pin is configured to resist said leaf spring from moving said hook to said closed position when said hook is in contract with said second pin.

21. A screen assembly for use with a vibratory separator to screen material and convey solids, comprising:

a frame mounted with the vibratory separator;

a first perforated "U" shaped screen support having an inwardly directed flange on a first edge of said first screen support and a ridge on a second edge of said first screen support;

a second perforated "U" shaped screen support having an inwardly directed flange on a first edge of said second support and a ridge on a second edge of said second screen support, wherein said first and second screen supports are attached to said frame and aligned parallel lengthwise to the direction of the conveyance of the solids, wherein said first and second screen supports are attached with each other along said first support ridge and said second support ridge, and wherein said attached first support ridge and second support ridge form a ridge slot;

a first screen element disposed on said first screen support and a second screen element disposed on said second screen support, wherein said first and second screen elements are configured to be "U" shaped;

a first hold down bar positioned on said attached first support ridge and second support ridge and over an edge of said first screen element and an edge of said second screen element, and wherein said hold down bar has a bar slot aligned with said ridge slot; and a hold down hook rotationally attached with said frame about a horizontal axis perpendicular to the direction of the conveyance of solids, wherein said hold down hook is disposed through said bar slot and said ridge slot, wherein said hold down hook is movable between an open position allowing outward movement of said hold down bar and said first and second screen elements, and a closed position blocking outward movement of said hold down bar and said first and second screen elements.

22. The screen assembly of claim 21, wherein said first screen element is compressively held in place adjacent to said first screen support by said hold down bar and said first support flange when said hook is in said closed position, and wherein said second screen element is compressively held in place adjacent to said second screen support by said hold down bar and said second support flange when said hook is in said closed position.

* * * * *